US006640812B2

(12) United States Patent
Ayzman

(10) Patent No.: US 6,640,812 B2
(45) Date of Patent: Nov. 4, 2003

(54) FILING TOOL FOR PEDICURE AND THE LIKE

(76) Inventor: Ilya Ayzman, 429 Muddy Branch Rd. Apt. 301, Gaithersburg, MD (US) 20878

( * ) Notice: Subject to any disclaimer, the term of this patent is extended or adjusted under 35 U.S.C. 154(b) by 222 days.

(21) Appl. No.: 09/782,007

(22) Filed: Feb. 14, 2001

(65) Prior Publication Data

US 2002/0153019 A1 Oct. 24, 2002

(51) Int. Cl.[7] ..... A45D 29/04
(52) U.S. Cl. ..... 132/76.4
(58) Field of Search ..... 132/76.4, 75.6, 132/76.5, 75.3, 73.5; 451/526, 532, 530, 533, 539, 523, 524, 525, 921

(56) References Cited

U.S. PATENT DOCUMENTS

| | | | | | |
|---|---|---|---|---|---|
| 4,459,987 | A | * | 7/1984 | Pangburn | 128/355 |
| 4,541,443 | A | * | 9/1985 | Brothers et al. | 132/75.6 |
| 5,176,155 | A | * | 1/1993 | Rudolph | 132/76.4 |
| 5,377,699 | A | * | 1/1995 | Varnum | 132/76.4 |
| 5,816,266 | A | * | 10/1998 | Cone | 132/76.4 |

* cited by examiner

*Primary Examiner*—John J. Wilson
*Assistant Examiner*—Robyn Kieu Doan
(74) *Attorney, Agent, or Firm*—I. Zborovsky

(57) ABSTRACT

A filing tool for pedicure and similar works has a support and a working element attached to the support, wherein the working element is formed as a screen with abrasive attached to the screen and composed of silicone carbide.

1 Claim, 4 Drawing Sheets

FILING TOOL FOR PEDICURE AND THE LIKE

BACKGROUND OF THE INVENTION

The present invention relates to a filing tool for a pedicure and the like.

During making pedicure it is necessary to remove calluses. For this purpose filing tools are utilized. A known filing tool includes a support and a layer with abrasive grains attached to the support. It is believed that the existing filing tools can be further improved.

SUMMARY OF THE INVENTION

Accordingly, it is an object of the present invention to provide a filing tool for pedicure and similar works, which is further improvement of the existing tool. In keeping with these objects one features of the invention resides in a filing tool which has a support and a working layer attached to the support, wherein the working layer is formed as a screen with abrasive attached to the screen and composed of silicone carbide.

When the tool is designed in accordance with the present invention, it provides an efficient removal of the tissue of calluses. Since the working layer is removably mounted on the support and is formed as a screen, the tool is easy to disassemble to be washed and cleaned. It increases the serve life and improves hygienic properties of the tool.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1A:
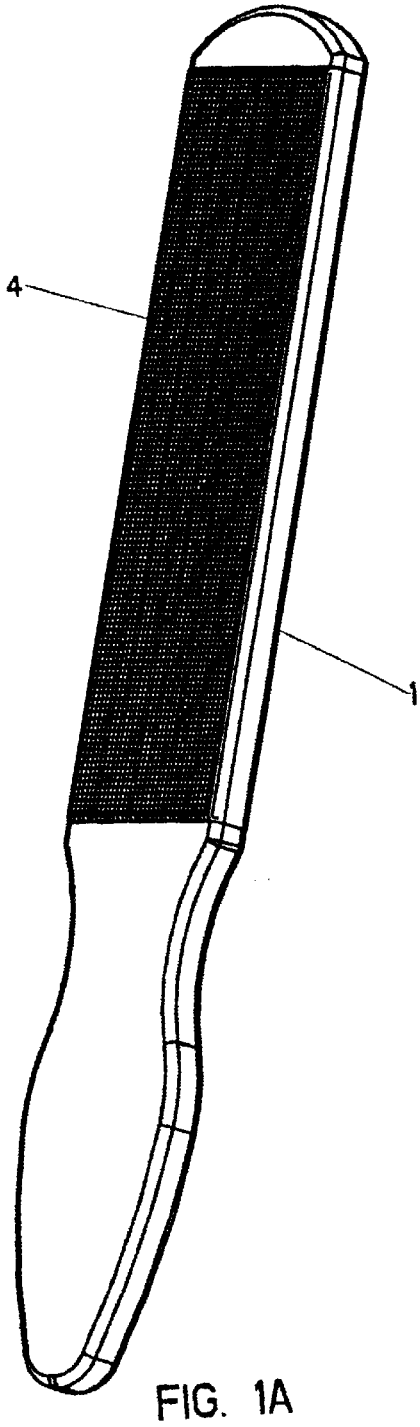
FIGS. 1A and 1B are perspective views of tool for filing in accordance with the first and second embodiment of the present invention.

A tool for filing in accordance with the present invention has a support which is identified with reference numeral 1 and 1'. The support has a handle part 2 and a main part 3 which is used for supporting a working element 4 and 4'. The working element 4 and 4' are composed of a supporting element 5 and 5' and a working layer 6.

The working layer 6 includes a screen 7 which can be composed of metal or plastic and includes a plurality of mutually perpendicular wires with spaces therebetween forming a plurality of square or rectangular throughgoing holes. Abrasive grains 8 are attached to the wires of the mesh

7. The abrasive material of the abrasive grains is preferably silicone carbide which is a sharp synthetic material that cuts fast. The silicone carbide grains are attached to the wires of the screen by known processes. For example, the grains of silicone carbide can be attached to metal wires by galvanic deposition, or attached to the plastic wires by adhesive.

Figure 3:
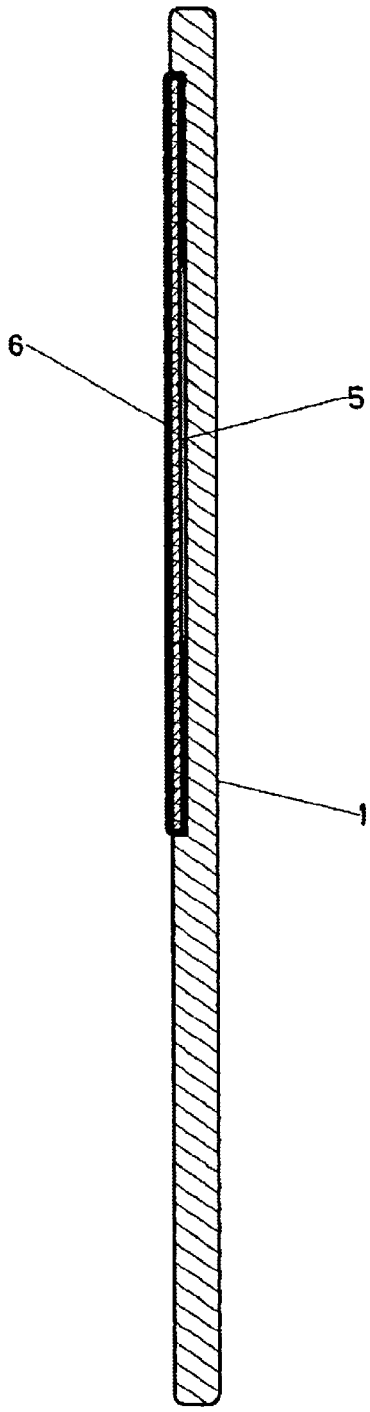
FIG. 3 is a side cross-section view A—A and FIG. 4 is an end cross-sectional view B—B on FIG. 2 in accordance with the first embodiment of the present invention.
Figure 4:
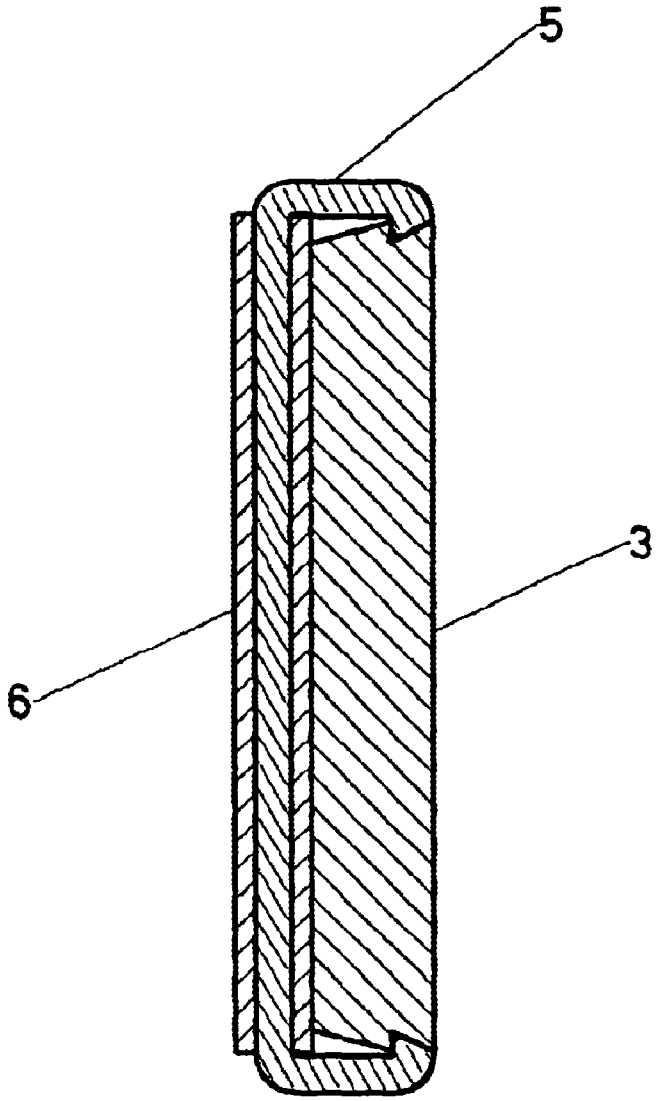

As can be seen from FIGS. 3 and 4, the working layer 6 is applied on the supporting element 5 and its ends in FIG. 3 are wrapped around the ends of the supporting element 5. The supporting element 5 has in a transverse direction, downwardly extending projections as shown in FIG. 4, which are somewhat elastic. In order to assemble the tool for filing the ends of the working layer 6 are wrapped around the ends of the supporting element 5, and the supporting element 5 is snapped onto the main part 3 of the support 1.

By holding the handle part 2 of the support 1 and rubbing the working layer 4 against a callus the tissue is efficiently removed.

Figure 1B:
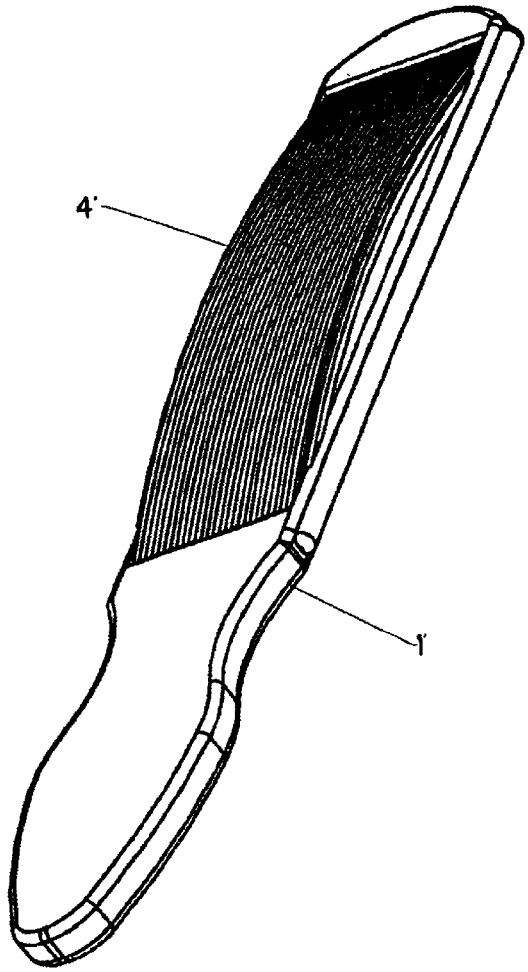
Figure 2:
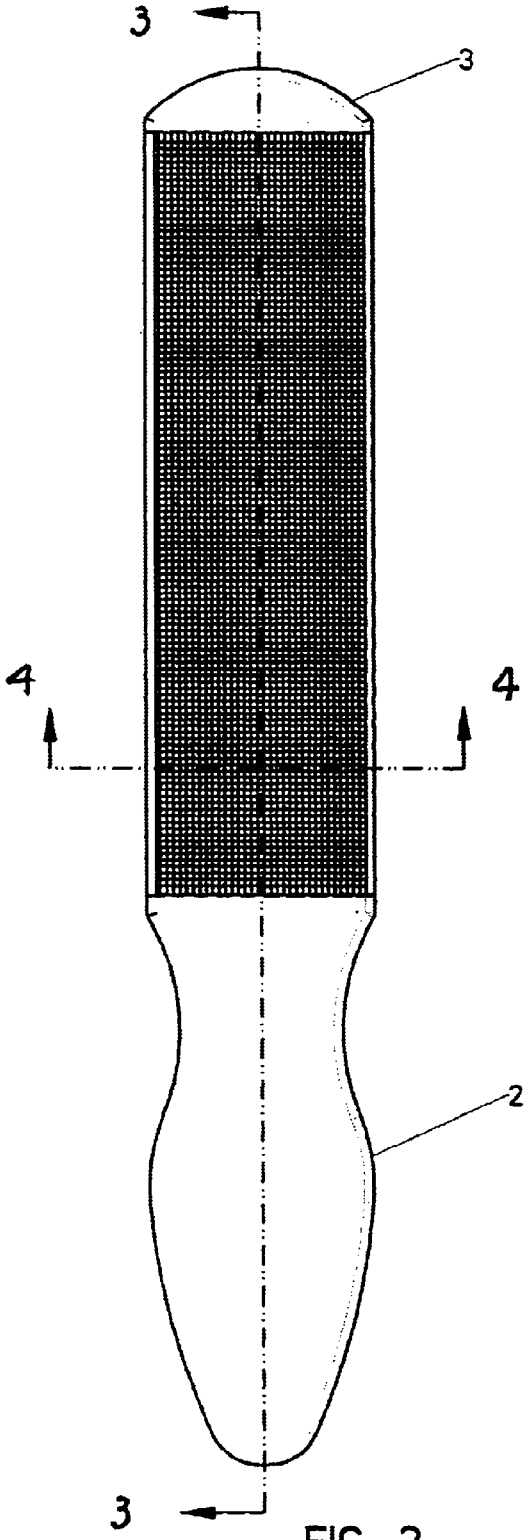
FIG. 2 is a top view of the tool.
Figure 5:
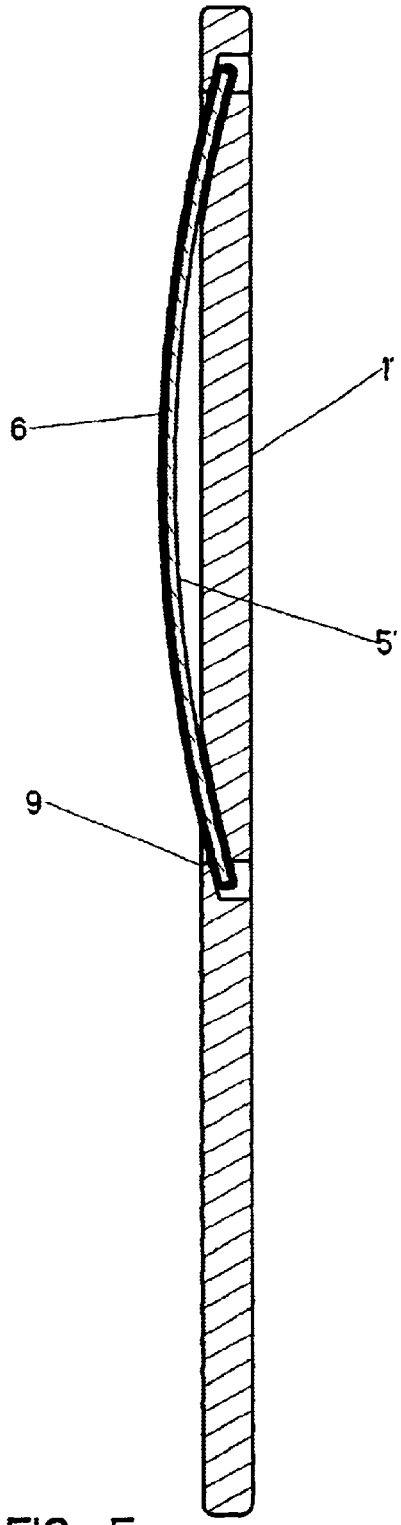
FIG. 5 is a side cross-sectional view A—A on FIG. 2 in accordance with another embodiment of the present invention.
Figure 6:
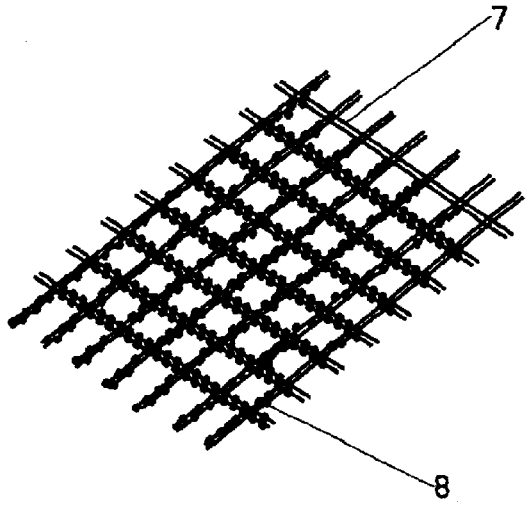
FIG. 6 is a view showing a working element of the inventive tool.

FIGS. 1B and 5 show another embodiment of the present invention. Here the supporting element 5' of the working element 4' is formed as an elastic, springy plate. The working layer 6 is again wrapped around the ends of the supporting element 5' and the supporting element is introduced into an undercut throughgoing recess 9 (opening) of the support 1' so that it slightly bulges outwardly. As a result, during the filing process the supporting element 5' together with the working layer 6 somewhat flexibly yields to improve the tissue removal process and to follow shape of the calluses.

While in the embodiment of FIGS. 1B and 5, the supporting element is springy, it is to be understood that the screen 7 itself can be springy so that it is attached to the support 1 in a manner shown in FIG. 5 without the supporting element 5', to provide a springy action during filing.

While the abrasive particles used on the screen are silicone carbide particles, also other abrasive can be utilized as well.

It will be understood that each of the elements described above, or two or more together, may also find a useful application in other types of constructions differing from the types described above.

While the invention has been illustrated and described as embodied in filing tool for pedicure and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A filling tool for pedicure and similar works, comprising a support, and a working element attached to said support, said working element being formed as a screen with abrasive attached to the screen and composed of abrasive particles, said working element has a working layer and a supporting element, said supporting element being wider than said working layer, said working layer of said working element having ends which are wrapped over transverse ends of said support element, said supporting element having bent side edges so that it is snappable on said support.

* * * * *